US010236601B2

(12) United States Patent
Sun

(10) Patent No.: US 10,236,601 B2
(45) Date of Patent: Mar. 19, 2019

(54) CARD EDGE CONNECTOR WITH ANTI-WICKING STRUCTURE

(71) Applicant: FOXCONN INTERCONNECT TECHNOLOGY LIMITED, Grand Cayman (KY)

(72) Inventor: Wei-Guo Sun, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/790,084

(22) Filed: Oct. 23, 2017

(65) Prior Publication Data

US 2018/0115092 A1 Apr. 26, 2018

(30) Foreign Application Priority Data

Oct. 21, 2016 (CN) ..... 2016 2 1145401 U

(51) Int. Cl.

| | |
|---|---|
| ***H01R 12/52*** | (2011.01) |
| ***H01R 13/05*** | (2006.01) |
| ***H01R 13/506*** | (2006.01) |
| ***H01R 4/02*** | (2006.01) |
| ***H01R 12/70*** | (2011.01) |
| *H01R 12/71* | (2011.01) |
| *H01R 12/83* | (2011.01) |

(52) U.S. Cl.

CPC ..... *H01R 12/52* (2013.01); *H01R 4/028* (2013.01); *H01R 12/707* (2013.01); *H01R 13/055* (2013.01); *H01R 13/506* (2013.01); *H01R 12/712* (2013.01); *H01R 12/83* (2013.01); *H01R 2201/06* (2013.01)

(58) Field of Classification Search

CPC .... H01R 12/52; H01R 13/055; H01R 13/506; H01R 2201/06; H01R 12/72; H01R 12/83; H01R 12/721; H01R 13/6275

USPC ..... 439/74, 325–328

See application file for complete search history.

(56) References Cited

U.S. PATENT DOCUMENTS

| | | | | |
|---|---|---|---|---|
| 6,666,702 | B1 * | 12/2003 | Pickles | H01R 12/716 439/326 |
| 7,985,089 | B2 * | 7/2011 | Zhu | H01R 12/721 439/326 |
| 8,052,449 | B2 * | 11/2011 | Zhu | H01R 13/6456 439/326 |
| 8,251,727 | B2 * | 8/2012 | Zhu | H01R 12/707 439/327 |

(Continued)

FOREIGN PATENT DOCUMENTS

| | | |
|---|---|---|
| CN | 202856007 U | 4/2013 |
| CN | 203631820 U | 6/2014 |

*Primary Examiner* — Tulsidas C Patel
*Assistant Examiner* — Travis Chambers
(74) *Attorney, Agent, or Firm* — Wei Te Chung; Ming Chieh Chang

(57) ABSTRACT

A card edge connector forms a plurality of passageways in the elongated housing to receive the corresponding contacts. Each contact has a retaining section secured to the housing, a resilient arm extending from an upper part of the retaining section with a contacting section exposed in the central slot, a soldering section extending from a lower part of the retaining section and out of the housing. A width of the passageway around the contacting section in the longitudinal direction is smaller than that around the soldering section.

18 Claims, 9 Drawing Sheets

(56) References Cited

U.S. PATENT DOCUMENTS

| | | | | |
|---|---|---|---|---|
| 2009/0023332 | A1* | 1/2009 | Ringler | H01R 12/585<br>439/513 |
| 2016/0056561 | A1* | 2/2016 | Mongold | H01R 12/72<br>439/327 |

* cited by examiner

CARD EDGE CONNECTOR WITH ANTI-WICKING STRUCTURE

BACKGROUND OF THE DISCLOSURE

1. Field of the Disclosure

The invention is related to an electrical connector, and particularly to the card edge connector equipped with anti-wicking structures of the housing.

2. Description of Related Arts

China Utility Patent No. CN 202856007U discloses a card edge connector including an insulative elongated housing, a plurality of terminals and a pair of latches at two opposite ends thereof. The housing forms a plurality of passageways in a slit form to receive the blanking type terminals therein, respectively. Because the interior surface of the passageway is so close to the side surfaces of the corresponding terminal, the capillary attraction may occur between the solder material and the terminal when the terminal is soldered upon the printed circuit board. China Utility Patent No. CN 203631820U discloses a modular jack connector with an upward facing cavity, as an anti-wicking structure, formed in the upward face of the footer insulator to which the vertically extending tail pins are secured so as to receive the redundant solder due to the capillary effect during soldering the connector to the printed circuit board.

Anyhow, the card edge connector is of a relatively fine pitch arrangement by using the blank/stamping type terminals while the footer of the modular jack connector requires a relative larger pin tail cooperating with a relatively larger pitch for securing consideration. Therefore, the anti-wicking structure disclosed in the aforementioned CN 603631820U is not efficiently fit for the card edge connector. Therefore, the It is desired to provide a card edge connector with thereof the efficient anti-wicking structures due to the capillary effect.

SUMMARY OF THE DISCLOSURE

To achieve the above desire, a card edge connector includes an elongated insulative housing extending along a longitudinal direction, and a row of first contacts arranged with one another along the longitudinal direction. The insulative housing includes a main body composed of two opposite first side wall and second side wall with a central slot therebetween. The first side wall forms a plurality of first passageway. The first side wall forms a mounting face opposite to the central slot. The first contact includes a first retaining section secured to the first side wall, a first resilient arm extending from an upper part of the first retaining section and extending into the central slot to form a contacting section, and a first tail section extending from a lower part of the first retaining section and out of the mounting face. The first resilient arm defines a first end adjacent to the first retaining section and right above the first tail section, and a second end adjacent to the contacting section wherein a gap between the interior surface of the first passageway and the first end in the longitudinal direction is larger than that between the interior surface of the first passageway and the second end. The gap around the second end is essentially slightly larger than a thickness of the first contact for efficiently restricting up-and-down movement of the contacting section with regard to the first passageway, and the gap around the first end is essentially relatively significantly larger than the thickness of the first contact for efficiently preventing capillary attraction with regard to the melted solder during soldering the first tail section upon the printed circuit board.

DETAILED DESCRIPTION OF THE PREFERRED EMBODIMENT

Figure 1:
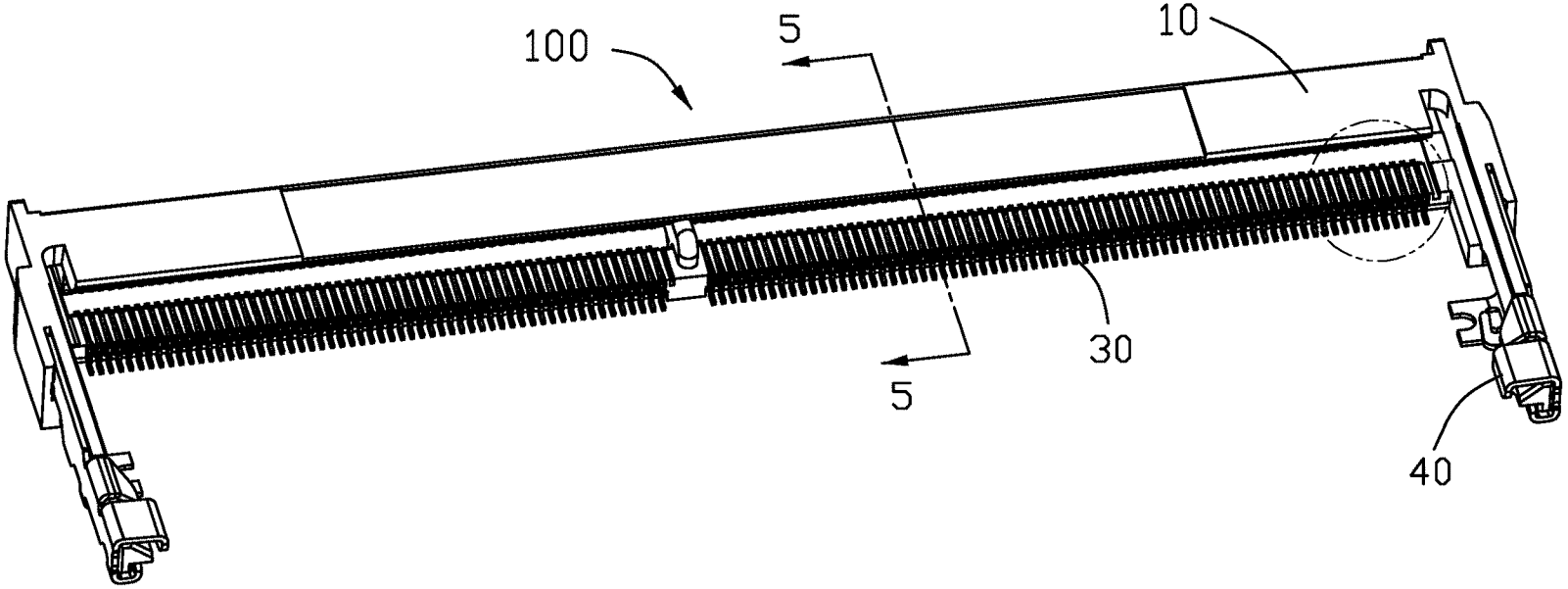
FIG. 1 is a perspective view of an electrical card edge connector according to the invention.
Figure 2:
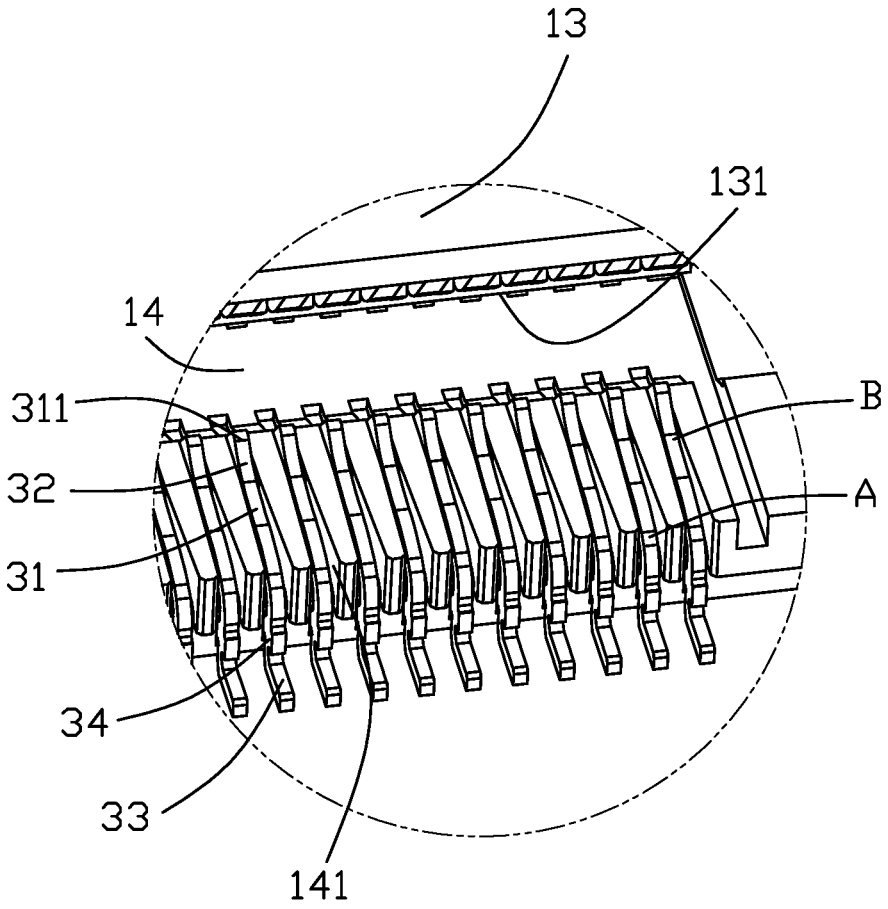
FIG. 2 is a partially enlarged perspective view of the electrical card edge connector of FIG. 1 to show the cavity formed by the housing beside the first resilient arm.
Figure 3:
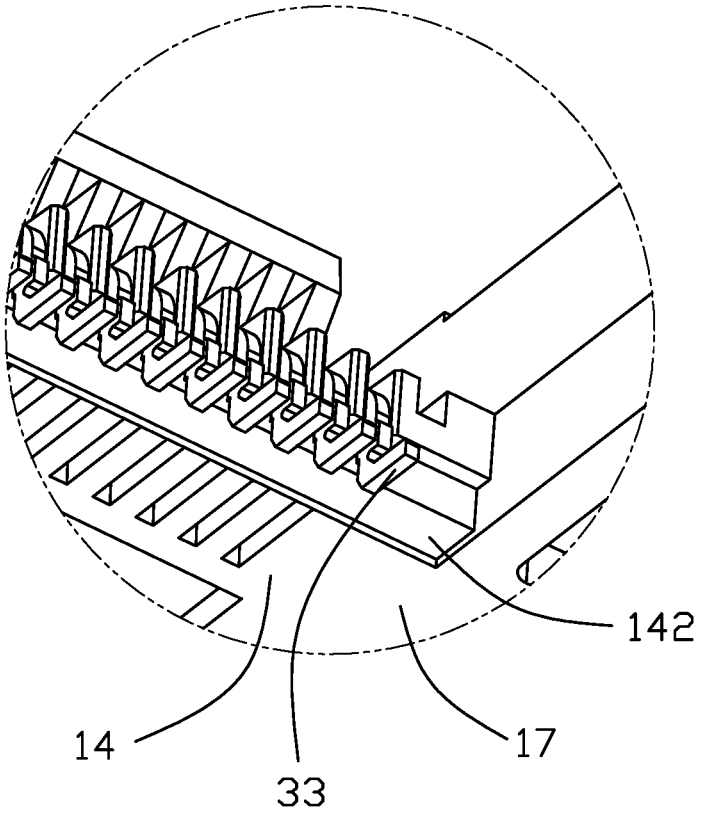
FIG. 3 is another partially enlarged perspective view of the electrical card edge connector of FIG. 1 to show the recess formed by the housing around the first tail section.
Figure 4:
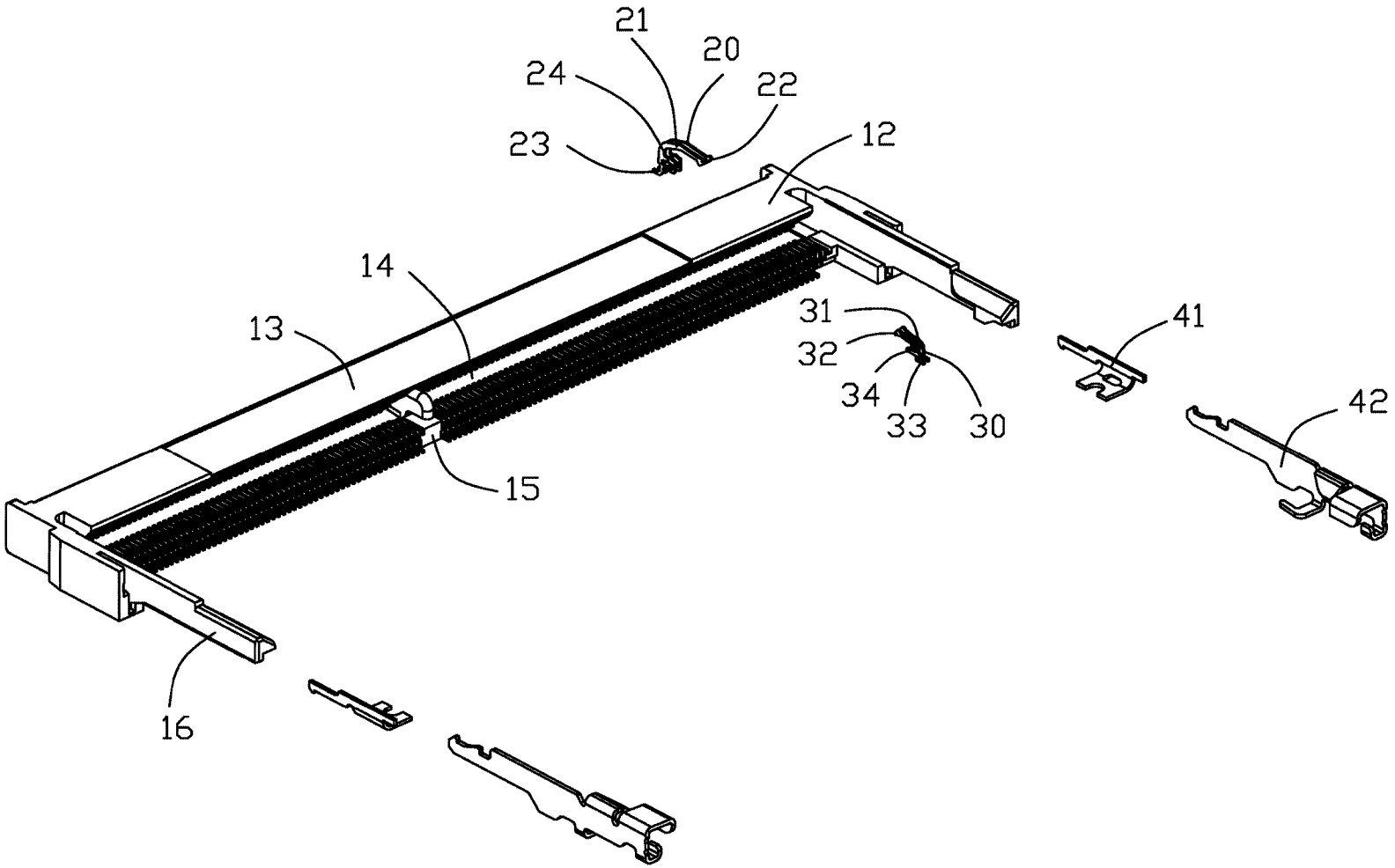
FIG. 4 is an exploded perspective view of the electrical card edge connector of FIG. 1.
Figure 5:
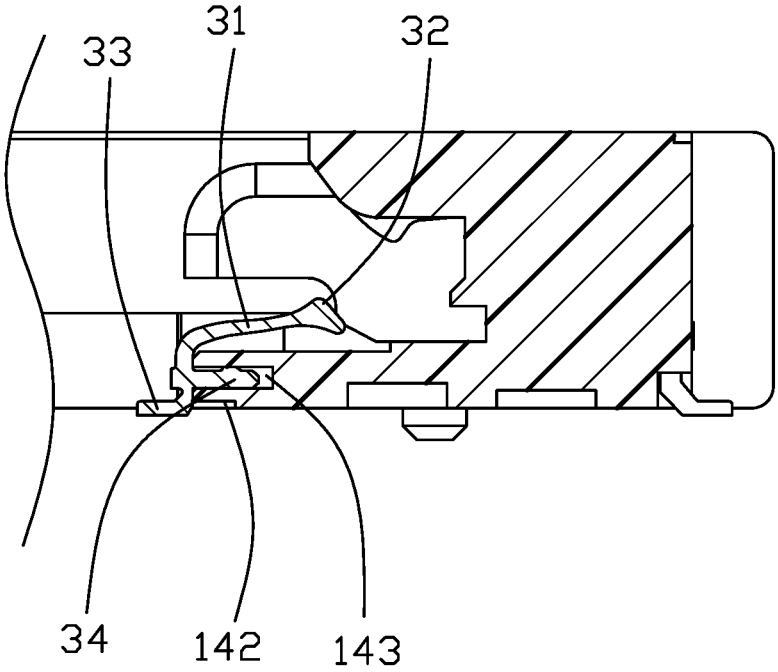
FIG. 5 is a partial cross-sectional view of the electrical card edge connector of FIG. 1.
Figure 6:
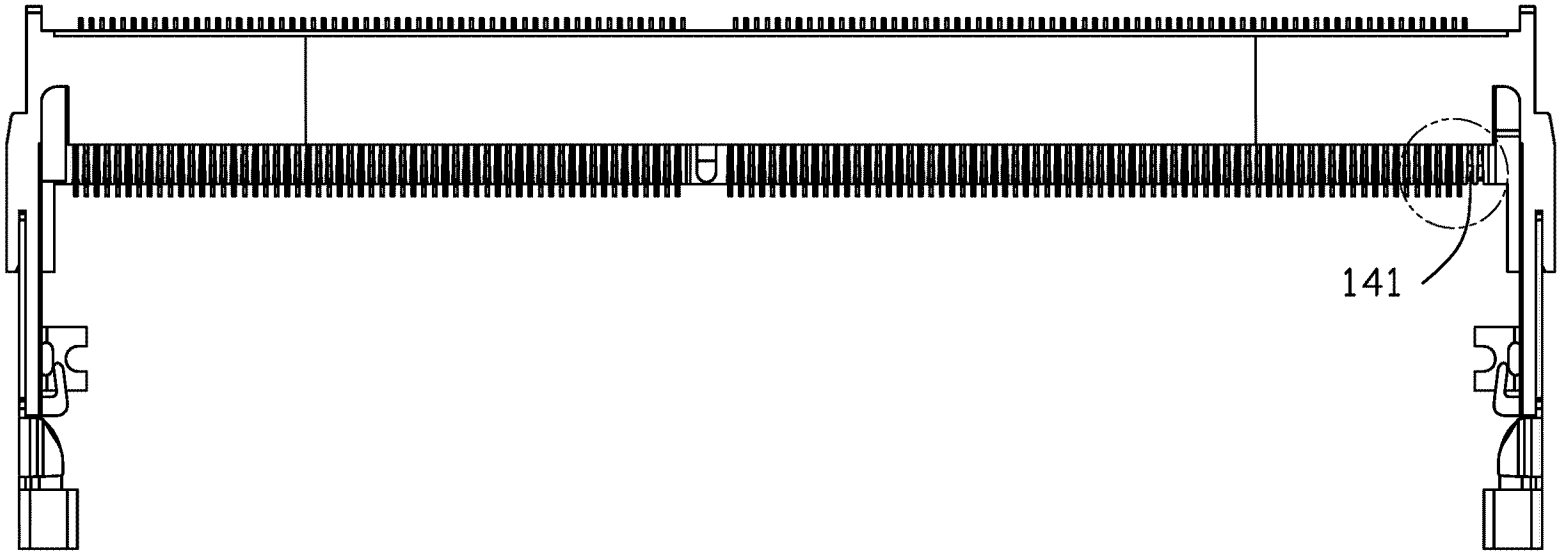
FIG. 6 is a top view of the electrical card edge connector of FIG. 1.

Reference will now be made in detail to the embodiments of the present disclosure. Referring to FIGS. 1-9 an electrical card edge connector assembly includes an electrical card edge connector 100 for mounting to a printed circuit board (not shown) and for mating with a memory module (not shown).

The connector 100 includes an elongated insulative housing 10 extending along a longitudinal direction, two rows of terminals disposed in the housing 1, and a pair of metal parts 40. The housing 1 includes a main body 12 extending along a longitudinal direction, and a pair of latching arms 16 forwardly extending, from two opposite ends of the main body 12, in a front-to-back direction perpendicular to the longitudinal direction. The metal part 40 includes a first metal piece 41 is secured to the corresponding latching arm 16 for mounting to the printed circuit board, and a second metal piece 42 is secured to the corresponding latching arm 16 and cooperates with latching arm 16 to hold the memory module.

The main body 12 includes a first/lower side wall 14 and a second/upper side wall 13 with a central slot 11 therebetween in a vertical direction perpendicular to both the longitudinal direction and the front-to-back direction. for receiving the memory module. The first side wall 14 forms a mounting face 17 opposite to the central slot 11 in the vertical direction. A key 15 formed in the central slot 11 for regulating orientation of the memory module. The first side wall 14 forms a plurality of first/lower passageways 141, and the second side wall 13 forms a plurality of second/upper passageway 131. The terminals include first/lower contacts 30 and the second/upper contacts 20 both of which are made by directly blanking. The first contact 30 includes a first retaining section 34 secured to the first side wall 14, a first resilient arm 31 extending from the upper part of the first retaining section 34 and within the first passageway 141 with a contacting section 32 at a free end thereof extending into the central slot 11 to form the contacting end or section 311, and a first tail/soldering section 33 extending from a lower part of the first retaining section 34 and out of the mounting face 17. The first resilient arm 31 defines a first end A around the first retaining section 34, and a second end B around the contacting end 311. The first resilient arm 31 is spaced from the interior face of the main body 12 in the first passageway 141 around the first end A with a gap, in the longitudinal direction, which is larger than another gap, in the longitudinal direction, with the interior face of the first passageway around the second end B. In other words, the first passageway 141 is configured to have only the contacting end 311 of the first resilient arm 31 snugly received therein for intimately confronting the corresponding interior face of the main body 12 therein with a tiny gap in the longitudinal direction, while having most remaining portions of the first resilient arm 31 distanced from the corresponding interior face of the main body 12 with a large space in the longitudinal direction so as to efficiently prevent the capillary effect around the first tail section 33. According to FIGS. 5, 7 and 8, in the front-to-back direction the dimension of the contacting end 311 is less than one third of that of the whole first resilient arm 31.

The second contacts 20 are received within the second side wall 13. The second contact 20 includes a second retaining section 24 securing to the second side wall 13, a second resilient arm 21 extending from an upper part of the second retaining section 24 with a second contacting section 22 extending into the central slot 11, and a second tail section 23 extending from a lower part of the second retaining section 24. The first contacting sections 32 and the second contacting section 22 are respectively located by two sides of the central slot 1 in the vertical direction.

The mounting face 33 forms a recess 142 between the first tail section 33 and the main body 12 to receive the redundant solder material. The first side wall 14 further includes a first retaining slot 143 to snugly receive and retain the first retaining section 34 therein.

Notably, the width of the first passageway 141 around the contacting section 32 is slightly larger than a thickness of the first contact 30 so as to allow the first resilient arm 31 to up and down move thereabouts in a reliable manner. Differently, the width of the first passageway 141 around the first retaining section 34, which is right above the first tail section 33, is relatively significantly larger than the thickness of the first contact 30 so as to prevent the capillary effect with regard to the melt solder material during soldering the first tail section 33 upon the printed circuit board. In other words, the width of the first passageway 141 around the first retaining section 34 is larger than that around the corresponding contacting section 32.

Figure 7:
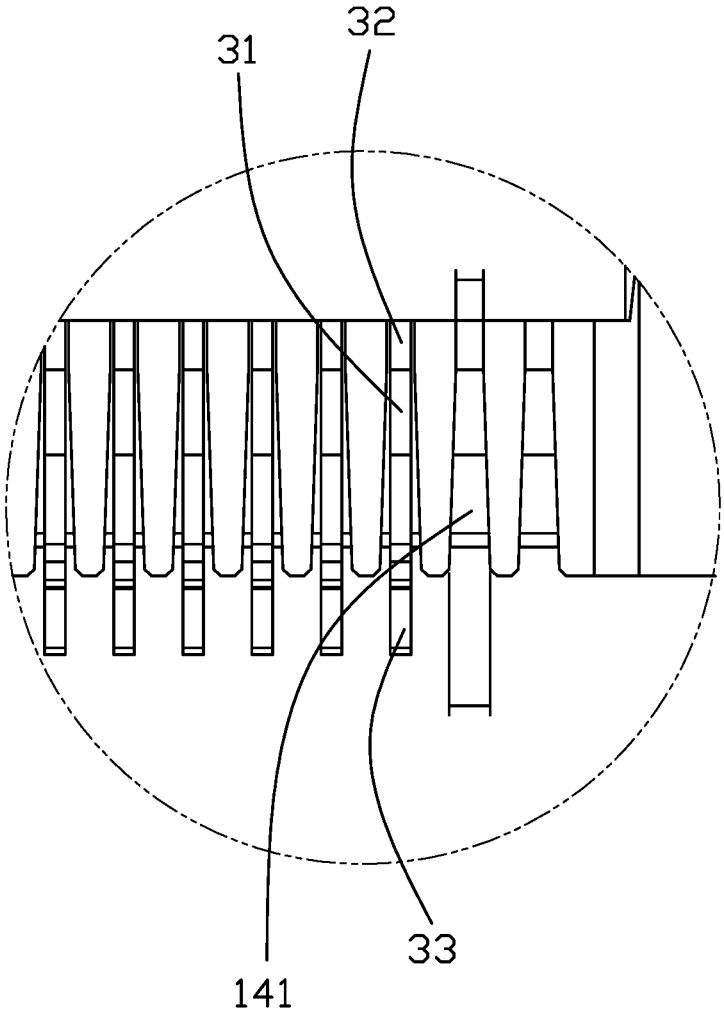
FIG. 7 is a partially enlarged top view of the electrical card edge connector of FIG. 1 to show the cavity formed by the housing beside the first resilient arm.
Figure 8:
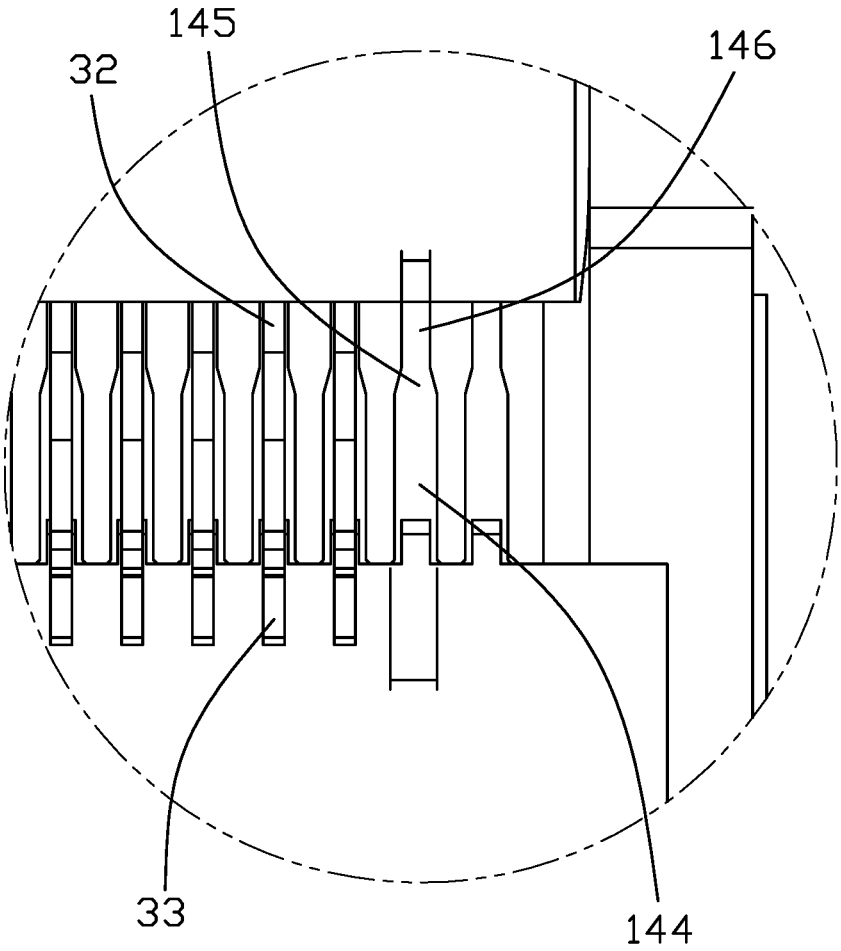
FIG. 8 is another partially enlarged top view of the electrical card edge connector according to another embodiment.
Figure 9:
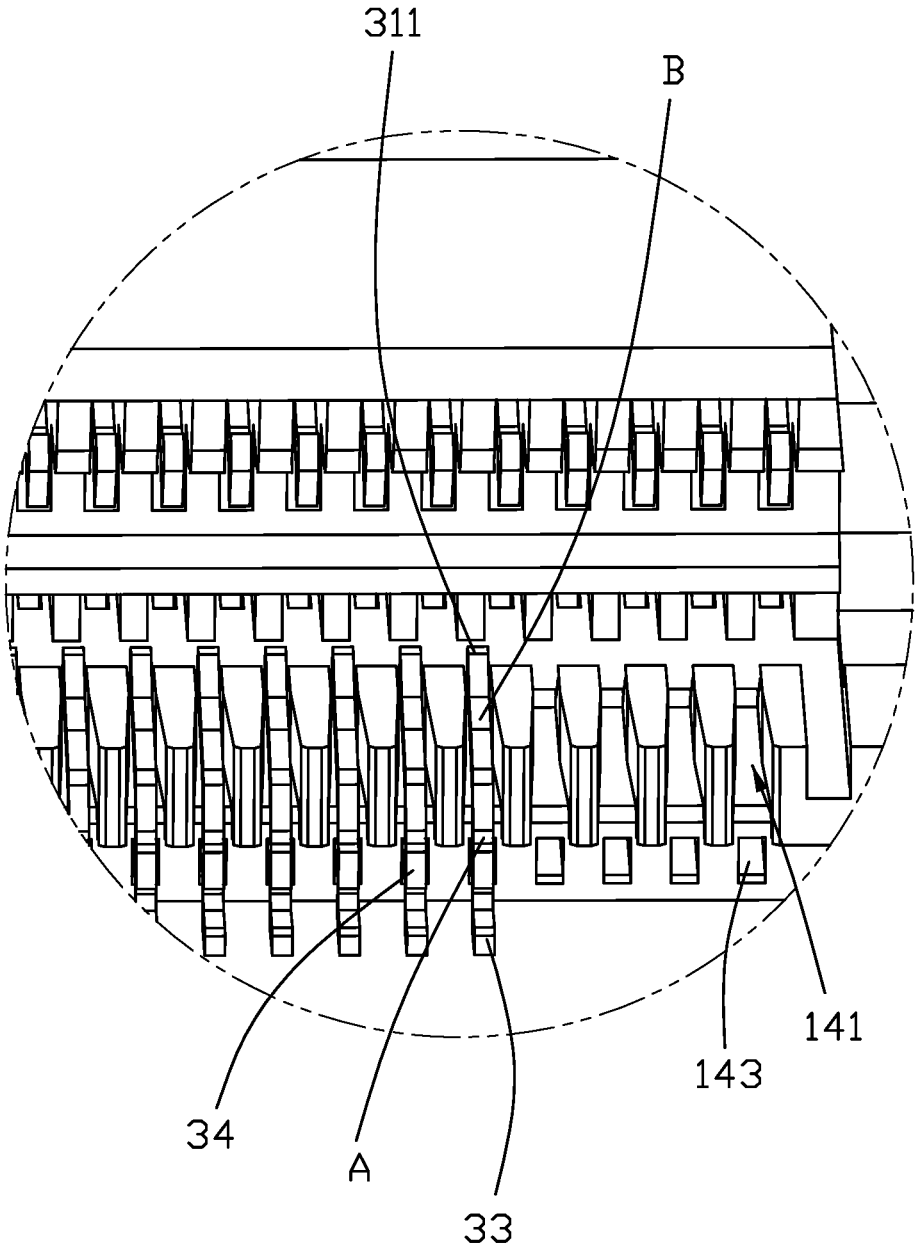
FIG. 9 is an partially enlarged perspective view of the electrical card edge connector of FIG. 1 to show the cavity formed by the housing relatively significantly larger than the first resilient arm around the first end.

FIG. 7 shows the width of the first passageway 141 extends in a gradually divergent manner from the second end B to the first end A. FIG. 8 shows the first passageway 141 having the narrower first section 146 around the second end B, the second section 145 and the broader third section 144 around the first end A wherein the first section 146 and the third section 146 extends in a straight front-to-back direction while the second section 145 linked between the first section 146 and the third section 144 in a tapered manner. Notably, in the invention even though the width of the first passageway 141 varies, that of the retaining slot 143 keeps constant similar to the thickness of the first contact 30.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. A card edge connector comprising:

an elongated insulative housing extending along a longitudinal direction and including opposite lower and upper side walls with a central slot therebetween in a vertical direction perpendicular to the longitudinal direction, the lower side wall defining a mounting face opposite to the central slot in the vertical direction;

a plurality of lower passageways formed in the lower side wall, each of said lower passageway extending in a front-to-back direction perpendicular to both said longitudinal direction and said vertical direction in a slit manner; and a plurality of lower contacts disposed in the corresponding lower passageways, respectively, each of said lower contacts including a retaining section secured to the lower side wall, a resilient arm extending from an upper part of the retaining section with at a free end a contacting section exposed in the central slot, a soldering section extending from a lower part of the retaining section and out of the mounting face; wherein a width of the lower passageway around the contacting section in the longitudinal direction is smaller than that around the soldering section; wherein the lower passageway is configured to have only the contacting section of the resilient arm snugly received therein for intimately confronting a corresponding interior face of the housing therein with a tiny gap in the longitudinal direction, while having most remaining portions of the resilient arm distanced from the corresponding interior face of the housing with a large space in the longitudinal direction so as to efficiently prevent capillary effect around the soldering section.

2. The card edge connector as claimed in claim 1, wherein a thickness of the lower contact extends along the longitudinal direction.

3. The card edge connector as claimed in claim 1, wherein the width of the lower passageway changes gradually.

4. The card edge connector as claimed in claim 1, wherein the width defines a narrower straight section around the contacting section, a broader straight section around the retaining section, and a tapered section therebetween.

5. The card edge connector as claimed in claim 1, wherein said lower side wall forms a recess in the mounting face to communicate with the soldering section in the front-to-back direction.

6. The card edge connector as claimed in claim 1, wherein the resilient arm extends rearwardly while the soldering section extends forwardly.

7. The card edge connector as claimed in claim 1, wherein a dimension of the contacting section is less than one third of that of the whole resilient arm along said front-to-back direction.

8. The card edge connector as claimed in claim 1, wherein said retaining section is secured within a retaining slot below, in the vertical direction, the lower passageway in which the resilient arm extends.

9. The card edge connector as claimed in claim 8, wherein a width of the retaining slot keeps constant.

10. A card edge connector comprising:

an elongated insulative housing extending along a longitudinal direction and including opposite first and second side walls with a central slot therebetween in a vertical direction perpendicular to the longitudinal direction, the lower side wall defining a mounting face opposite to the central slot in the vertical direction;

a plurality of first passageways formed in the first side wall, each of said first passageway extending in a front-to-back direction perpendicular to both said longitudinal direction and said vertical direction in a slit manner; and a plurality of first contacts disposed in the corresponding lower passageways, respectively, each of said first contacts including a retaining section secured to the first side wall, a resilient arm extending from an upper part of the retaining section with at a free end a contacting section exposed in the central slot, a soldering section extending from a lower part of the retaining section and out of the mounting face; wherein a width of the first passageway around the contacting section in the longitudinal direction is smaller than that around the soldering section; wherein the lower passageway is configured to have only the contacting section of the resilient arm snugly received therein for intimately confronting a corresponding interior face of the housing therein with a tiny gap in the longitudinal direction, while having most remaining portions of the resilient arm distanced from the corresponding interior face of the housing with a large space in the longitudinal direction so as to efficiently prevent capillary effect around the soldering section.

11. The card edge connector as claimed in claim 10, wherein a thickness of the first contact extends along the longitudinal direction.

12. The card edge connector as claimed in claim 10, wherein the width of the first passageway changes gradually.

13. The card edge connector as claimed in claim 10, wherein the width defines a narrower straight section around the contacting section, a broader straight section around the retaining section, and a tapered section therebetween.

14. The card edge connector as claimed in claim 10, wherein said first side wall forms a recess in the mounting face to communicate with the soldering section in the front-to-back direction.

15. The card edge connector as claimed in claim 10, wherein the resilient arm extends rearwardly while the soldering section extends forwardly.

16. The card edge connector as claimed in claim 10, wherein a dimension of the contacting section is less than one third of that of the whole resilient arm along said front-to-back direction.

17. The card edge connector as claimed in claim 10, wherein said retaining section is secured within a retaining slot below, in the vertical direction, the lower passageway in which the resilient arm extends.

18. The card edge connector as claimed in claim 17, wherein a width of the retaining slot keeps constant.

* * * * *